United States Patent [19]

Harris

[11] 4,397,351

[45] Aug. 9, 1983

[54] PACKER TOOL FOR USE IN A WELLBORE

[75] Inventor: Monty E. Harris, Cleveland, Okla.

[73] Assignee: The Dow Chemical Company, Midland, Mich.

[21] Appl. No.: 258,213

[22] Filed: Apr. 27, 1981

Related U.S. Application Data

[63] Continuation-in-part of Ser. No. 35,159, May 2, 1979, abandoned.

[51] Int. Cl.[3] ..... E21B 23/06; E21B 33/129

[52] U.S. Cl. ..... 166/134; 166/182; 166/217

[58] Field of Search ..... 166/134, 135, 382, 140, 166/138, 181, 182, 123; 277/116.2

[56] References Cited

U.S. PATENT DOCUMENTS

| | | | |
|---|---|---|---|
| 1,525,368 | 2/1925 | Cameron | 166/182 |
| 2,255,451 | 9/1941 | Otis | 166/140 |
| 3,061,013 | 10/1962 | Thomas, Jr. | 166/134 |
| 3,374,840 | 3/1968 | Current | 166/134 |

*Primary Examiner*—William F. Pate, III
*Assistant Examiner*—Hoang C. Dang
*Attorney, Agent, or Firm*—V. Dean Clausen; L. Wayne White

[57] ABSTRACT

A packer tool, and method for permanently setting the tool, in a packed off position, in a well casing, is disclosed. The tool includes lower slips which are slideable upwardly on a lower cone, and upper slips which are slideable downwardly on an upper cone. The lower slips are set against the casing wall first by applying downward force against the lower cone. After the lower slips have been set, additional downward force is applied against the packer tool to set the upper slips against the casing wall.

8 Claims, 6 Drawing Figures

PACKER TOOL FOR USE IN A WELLBORE

CROSS-REFERENCE TO RELATED APPLICATION

This application is a continuation-in-part of U.S. Application Ser. No. 035,159, filed May 2, 1979 abandoned.

BACKGROUND OF THE INVENTION

The invention relates broadly to a packer tool for plugging off a well casing. More specifically, the invention covers a packer tool of the permanent type.

In the production of oil and gas there are various downhole operations which require plugging off the well casing at a given point, or at more than one point. Examples of such operations are hydraulic fracturing of a producing zone, and placing of propping materials, such as sand, in the fracture opening. When such operations are to be performed, the well casing is usually plugged off with a packer tool, either a permanent-type packer, or a retrievable packer.

The packet tools now available are not entirely satisfactory because of various problems. A major problem is in the "setting" of the packer in the casing. When force is applied from the wellhead, to "set" the tool in place, the teeth of the upper and lower slips on the tool grip into the casing wall simultaneously. At the same time, the rubber packing elements are only partly compressed, so that they do not set tightly against the casing wall. As additional force is applied, to further set the packing elements, the packer tool moves down and the slips drag along the casing wall. This causes the slip teeth to become dull in a very short time, and the packer is then unable to form a good fluid-tight plug in the casing.

The packer tool of this invention, which is designed to be permanently set in a well casing, avoids the problem described above. This tool is designed such that the lower slips are set first, followed by setting of the upper slips, with only a slight movement of the packer in the casing during the setting operation.

The tools described in U.S. Pat. Nos. 2,753,941 (Hebard et al.), 3,061,013 (Williams), and 3,517,742 (Thomas) are representative of prior art packers and bridging plugs which are used in plugging off a well casing to perform a downhole operation. Although the tools described in these references are suitable for plugging off a well casing, the structure and operation of each tool is substantially different than the packer tool of the present invention. In particular, none of the prior tools have the capability for setting the slip members in the manner of the present packer, to avoid the drag problem described above.

SUMMARY OF THE INVENTION

The packer tool of this invention is designed to be permanently set, in a packed off position, in a well casing. The basic component of the tool is an elongate mandrel, which has a section of teeth defined in the outer surface of the mandrel. The mandrel is enclosed by several upper components, which include an upper cone, an upper sleeve, a set of upper slips, and a means for locking the upper cone into a first and second position on the mandrel. The mandrel is also enclosed by lower components which include a lower cone and a set of lower slips.

A set of packing elements are also fitted around the mandrel and positioned between the upper and lower cones. When the packer tool is being run into the well casing, that is, before the slips are set, the upper cone is positioned on the mandrel such that it can slide downwardly. The upper sleeve is fastened to the mandrel and to the upper cone. The upper slips, which are slideable downwardly on the upper cone, are seated against the upper sleeve prior to setting of these slips. The lower cone is secured to the mandrel; and the lower slips, which are slideable upwardly on the lower cone, are seated against a lower guide on the mandrel prior to setting of these slips.

During setting of the upper and lower slips, the packing elements are compressed, such that they expand outwardly and push against the well casing to form a fluid-tight seal. In the setting operation, the lower slips are set against the well casing first, and the lower cone is locked against the mandrel, in a given position, by the lock means. Thereafter, the upper slips are set against the casing and the upper cone moves to a second position on the mandrel, where it is held in place by the lock means.

DESCRIPTION OF THE PREFERRED EMBODIMENT

Figure 1A:
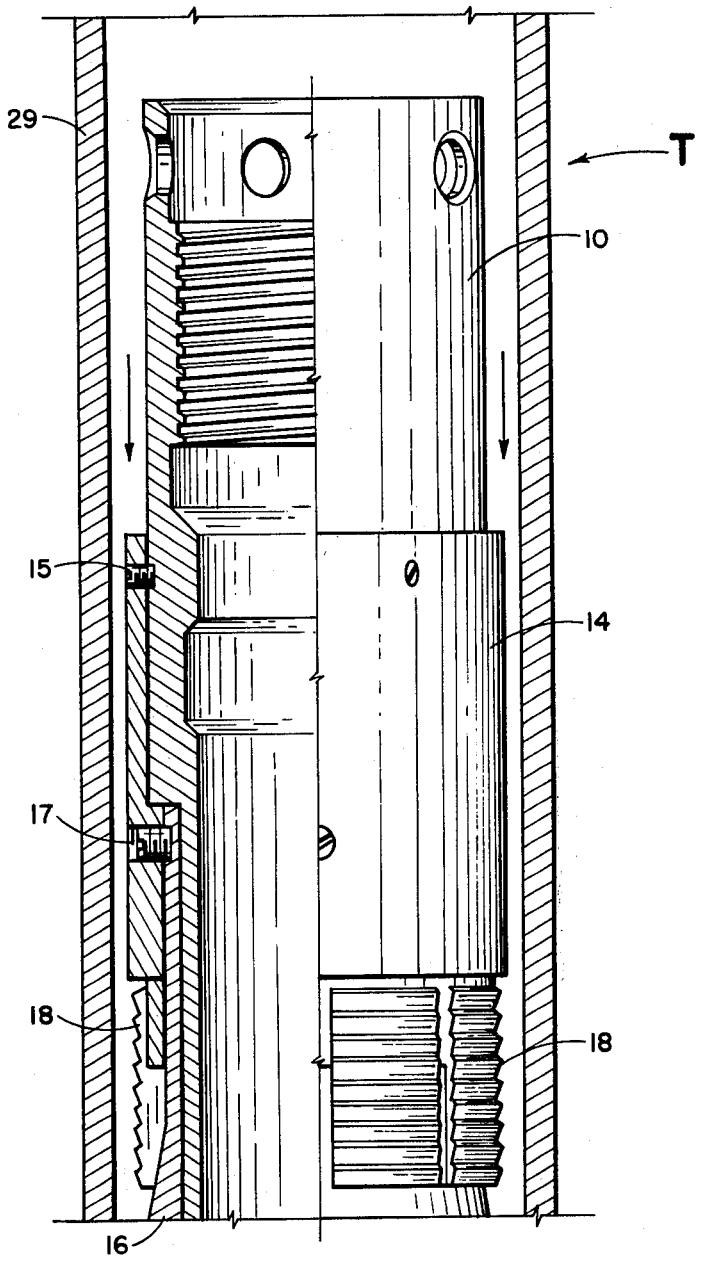
FIG. 1A is a partial view, in front elevation, and partly in section, which illustrates the upper part of the present packer tool.

In the drawings, the letter T generally indicates the packer tool of this invention. The basic tool is made up of a hollow, elongate mandrel 10. The mandrel includes a section of teeth 11, which is machined into the outer wall surface of the mandrel near the middle of this component. A lower guide member 12 is threaded onto the bottom end of the mandrel 10 and held in place by a set screw 13. A sleeve 14 is fitted to the mandrel 10 just below the top of the mandrel. The sleeve is held in place on the mandrel by several shear screws, indicated by numeral 15.

An upper cone 16 is fitted to the mandrel 10 and held in place by several shear screws 17, which are threaded through the sleeve 14. A set of upper slips 18 are fitted to the cone 16, such that they can slide downwardly along the cone. A lock ring 19 is threaded onto the upper cone 16. The inside of this ring has a teeth section (not numbered) which engages the teeth section 11 on mandrel 10. Ring 19 is also fastened to the cone 16 by a set screw 20.

An expanding gage ring 21 is fitted to mandrel 10 below the upper cone 16. Farther down on mandrel 10 is a similar gage ring 22. Between the two gage rings is a set of packer elements which fit around the mandrel. These elements are made up of two outer packer elements, 23 and 24, and a center element 25. A lower cone 26 fits around the mandrel below the gage ring 22 and the cone is secured to the mandrel by several set screws, indicated by numeral 27. Means for setting the lower part of the packer tool T is provided by a set of lower slips 28, which are positioned to slide upwardly along cone 26.

Operation

Figure 1B:
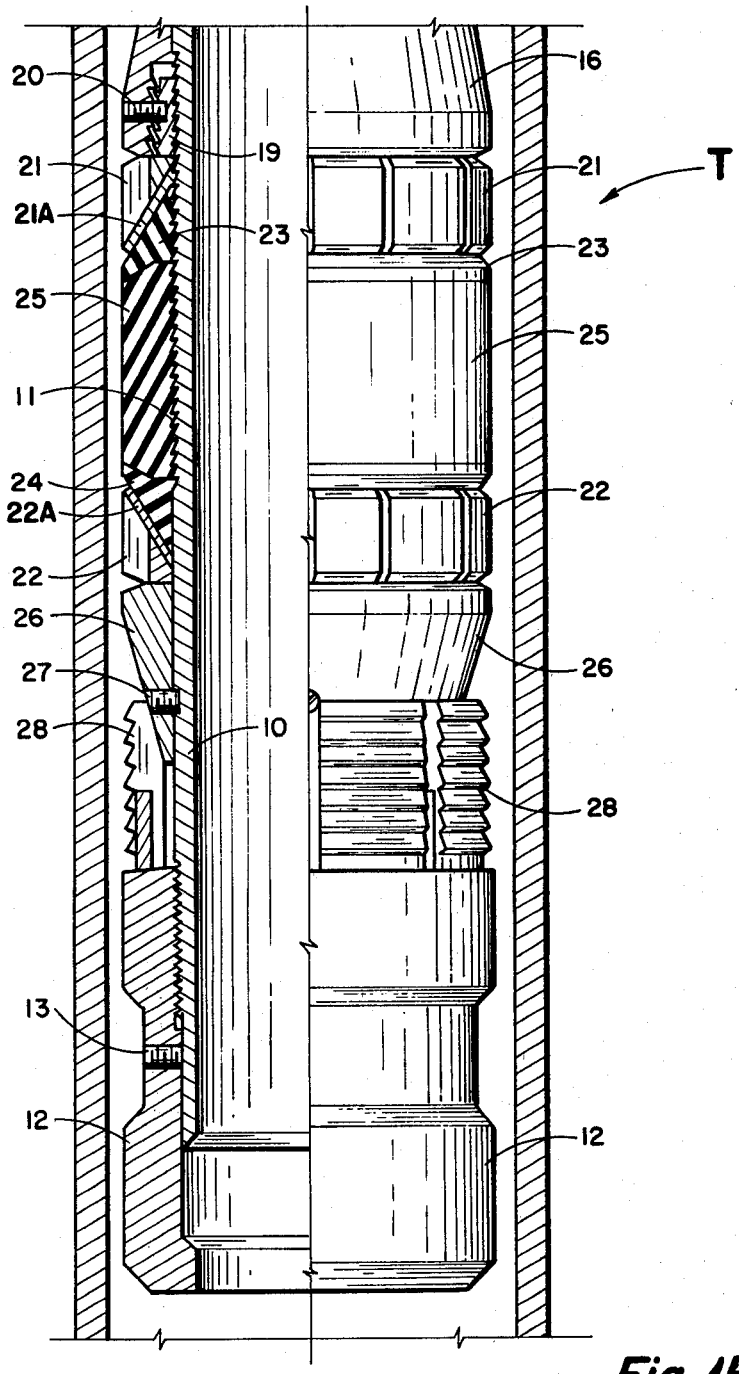
FIG. 1B illustrates the lower part of the tool. In these Figures, the tool is shown in its running-in position.
Figure 2A:
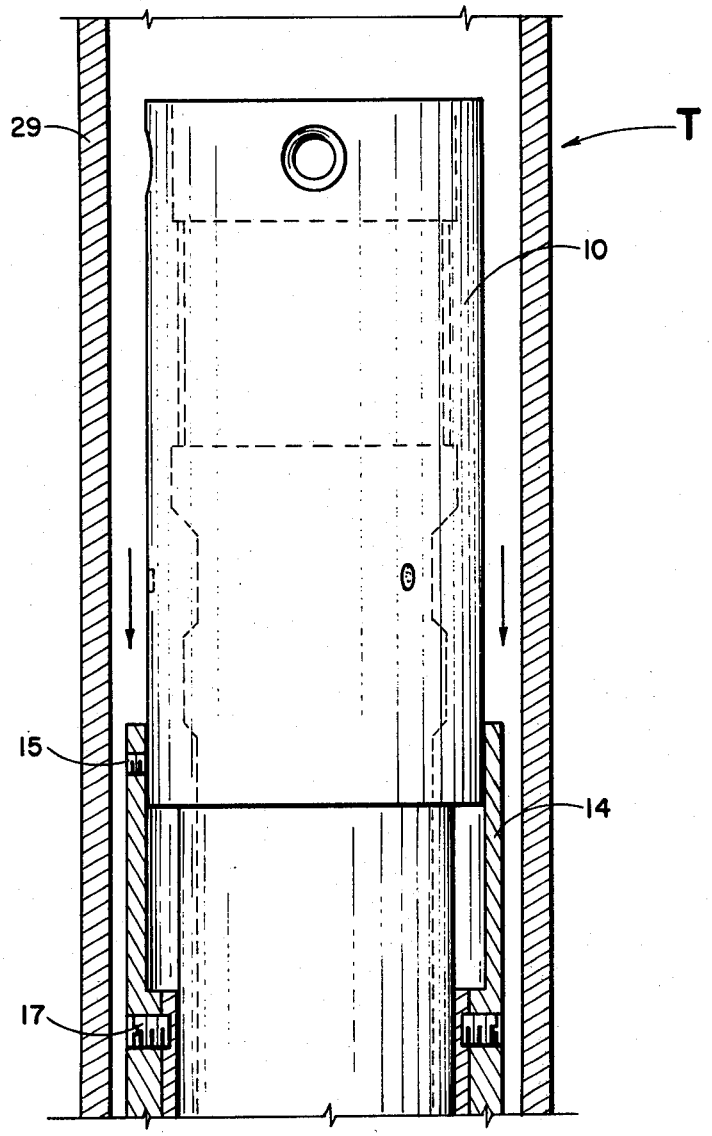
FIG. 2A is a partial view, in front elevation, and partly in section, showing only the upper part of the packer tool after the lower slips have been set.
Figure 2B:
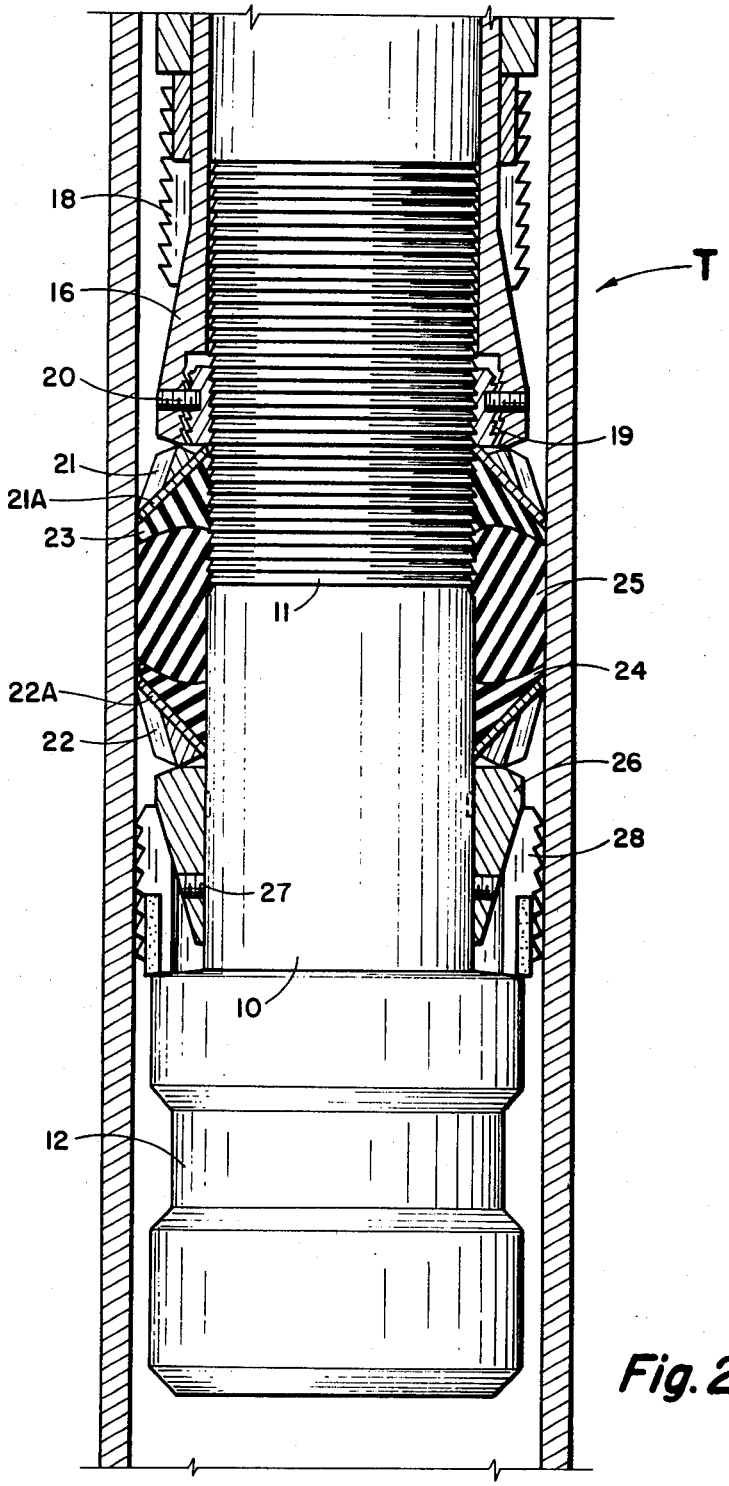
FIG. 2B shows only the lower part of the tool after setting the lower slips.

The basic operation of the present packer tool will now be described to illustrate the practice of this invention. In a typical down hole operation, the top of the mandrel 10 is connected to a wire line setting tool, which, in turn, is fastened to the bottom end of a tubing string. The setting tool and the tubing string are not shown in the drawing. The packer tool T is then lowered on the string into the well casing 29, until it reaches the point where the casing is to be packed off. At this point, the tool is in its running in position, as shown in FIGS. 1A and 1B. The next step is to set the lower slips 28, as shown in FIGS. 2A and 2B.

A sleeve (not shown) on the setting tool seats against the sleeve 14. The resulting downward force against the sleeve 14 off the screws 15, so that sleeve 14 moves downwardly on the mandrel 10. Upper cone 16 also moves downwardly along with sleeve 14, because the cone is held securely to the mandrel by the larger shear screws 17. As cone 16 moves down, the inside teeth on the lock ring 19 "ratchet" downwardly on the mandrel teeth 11. When cone 16 reaches its lowest point of travel, the ring 19 locks the cone against the mandrel 10, to prevent undesired upward movement of the packer components.

The downward movement of upper cone 16 compresses the packer elements 23, 24 and 25 between cone 16 and the lower cone 26. This causes the packer elements to expand outwardly and push against the outside wall of the casing 29, to form a fluid-tight seal at this point in the casing. The compression of the packer elements also forces the expanding gage ring 22 to push down on lower cone 26, with enough force to shear off the screws 27. As cone 26 moves down, the lower slips 28 ride upwardly on the cone and move outwardly until they grip into the wall of casing 29. The lower slips are then in the fully set position shown in FIG. 2B.

Figure 3A:
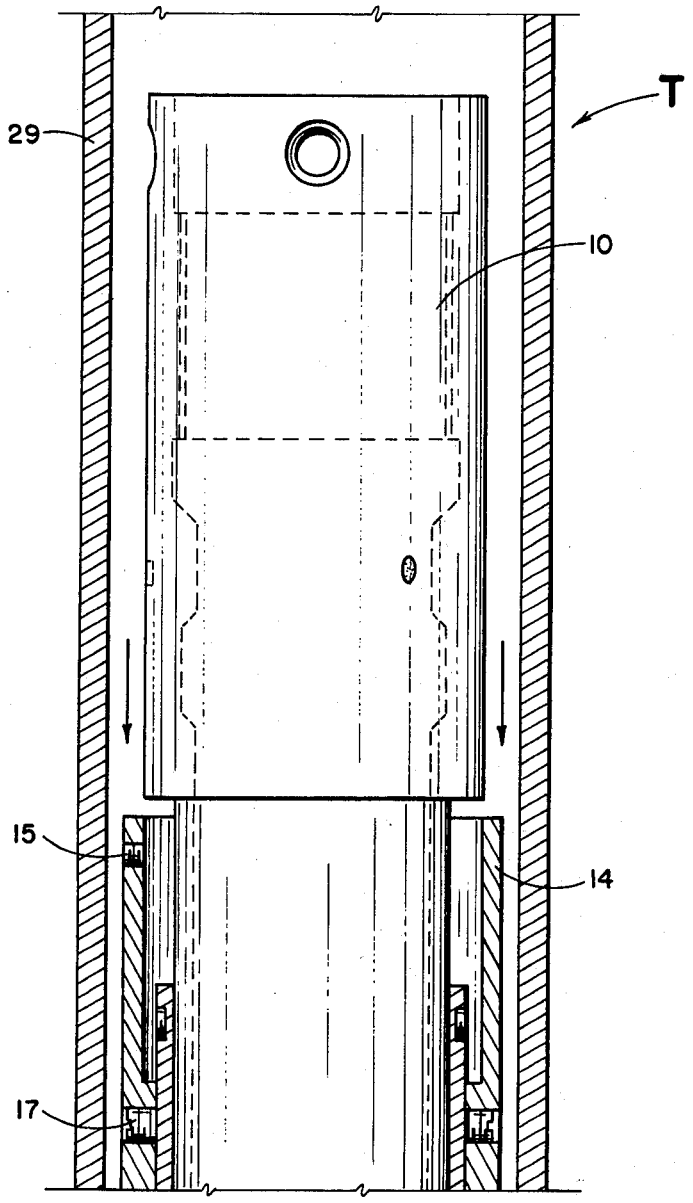
FIG. 3A is a partial view, in front elevation, and partly in section, showing only the upper part of the packer tool after both the lower and upper slips have been set.
Figure 3B:
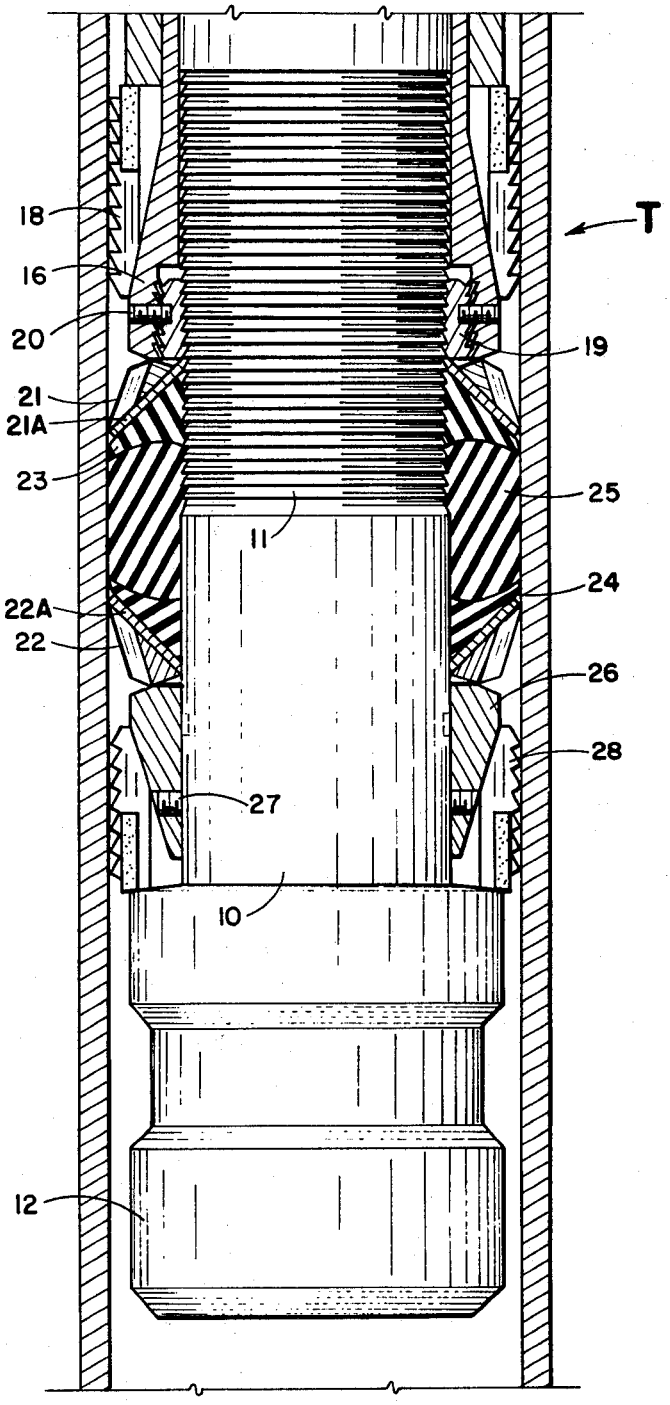
FIG. 3B shows only the lower part of the tool after setting of the lower and upper slips.

The next step is to set the upper slips 18, as illustrated in FIGS. 3A and 3B. This sequence is started by applying enough additional downward force, through the setting tool, to shear off the larger shear screws 17, which secure the sleeve 14 to the upper cone 16. When these screws are sheared, the sleeve 14 moves downwardly on the upper cone. At the same time, the sub piece pushes the upper slips 18 downwardly on the upper cone. This causes the upper slips to move outwardly until they grip into the wall of casing 29. The upper slips are then in the fully set position shown in FIG. 3B.

The next step is to release the setting tool from the packer tool. This is done by applying enough additional downward force against the setting tool to shear the connection which fastens the setting tool to the top of mandrel 10. This connection is not shown in the drawings. When the connection is broken, the tubing string and setting tool are then pulled out of the casing, so that the packer tool is left in the casing as a permanent structure.

Adequate clearance is required between the lock ring 19 and the upper cone 16 to allow the lock ring to ratchet and advance along teeth section 11 on the mandrel.

A slotted back-up ring 21A is positioned between the packer element 23 and the expanding gage ring 21. A similar back-up ring 22A is positioned between the packer element 24 and the gage ring 22. The purpose of the back-up rings is to cover the enlarged slots of the expanded gage ring and to thereby prevent extrusion of the packer elements past the openings in the expanded gage ring during compression of the packer elements and after setting of the lower and upper slips. The purpose is conveniently achieved by positioning the back-up rings in such a way that the slots in the back-up ring are staggered relative to the slots in the expanding gage ring. Usually the slots in the expanding gage rings are uniformly positioned around the rings and also around the back-up rings. The number of slots in the expanding gage rings is not critical, but Application has found an even number of slots to be convenient (e.g. 4, 6, 12, etc.). Likewise, the number of slots in the back-up rings is not critical, but Applicant has found it convenient to use the same number of slots in the back-up ring as is used in the associated expanding gage ring. For example, if the expanding gage ring contains 6 slots uniformly positioned around the ring (which is typical), then normally the back-up ring would also contain 6 slots uniformly positioned around its circumference; however, other combinations could obviously be used (e.g. 12 slots in the expanding gage ring and 6 slots in the back-up ring, or 6 slots in the expanding gage ring and 3 slots in the back-up ring.

What is claimed is:

1. A packer tool adapted to be permanently set, in a packed off position, inside a well casing, the tool comprising:

an elongate mandrel which has a teeth section defined on its outer surface, the mandrel is enclosed by upper components which include an upper cone member slideable downwardly on the mandrel, an upper sleeve member fastened to the mandrel and to the upper cone member, a set of upper slip members which seat against the upper sleeve and which are slidable downwardly on the upper cone member, and means fastened to the upper cone member, for locking the upper cone into a first position on the mandrel, and thereafter locking the upper cone into a second position on the mandrel;

the mandrel is enclosed by lower components which include a lower cone member secured to the mandrel, and a set of lower slip members slideable upwardly on the lower cone member; and a set of packing elements which enclose the mandrel, and which are positioned on the mandrel between the upper cone member and the lower cone member.

2. The tool of claim 1 in which the elongate mandrel is a hollow mandrel.

3. The tool of claim 1 in which the locking means is a ring positioned between the upper cone member and the mandrel, the ring is fastened into the upper cone member, and the ring has a teeth section engageable with the teeth section on the mandrel.

4. The tool of claim 1 in which the upper sleeve member is fastened to the mandrel by a first group of shear pins, and said upper sleeve member is slidable downwardly on the mandrel, to a first position, upon rupture of said shear pins.

5. The tool of claim 4 in which the upper sleeve member is fastened to the upper cone member by a second group of shear pins, and said upper sleeve member is slidable downwardly from the first position to a second position, upon rupture of said shear pins.

6. The tool of claim 1 which further includes a first expandable ring member positioned between the upper cone member and the packing elements.

7. The tool of claim 1 which further includes a second expandable ring member positioned between the lower cone member and the packing elements.

8. The tool of claim 1 which further includes a setting means which can be attached to the tool, and which is adapted to cause the lower slips to engage and set against the well casing, and thereafter to cause the upper slips to engage and set against the well casing.

* * * * *

UNITED STATES PATENT AND TRADEMARK OFFICE

CERTIFICATE OF CORRECTION

PATENT NO. : 4,397,351

DATED : Aug. 9, 1983

INVENTOR(S) : Monty E. Harris

It is certified that error appears in the above—identified patent and that said Letters Patent is hereby corrected as shown below:

Column 3, line 23, after "14" insert --shears--.

Column 4, line 18, delete "Application" and insert --Applicant--.

Signed and Sealed this

Tenth Day of January 1984

[SEAL]

*Attest:*

GERALD J. MOSSINGHOFF

*Attesting Officer*

*Commissioner of Patents and Trademarks*